US006651555B2

(12) United States Patent
Szarka

(10) Patent No.: US 6,651,555 B2
(45) Date of Patent: Nov. 25, 2003

(54) DAMPENING SOLUTION RECIRCULATOR

(75) Inventor: Sandor Szarka, Franklin Lakes, NJ (US)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 09/962,941

(22) Filed: Sep. 24, 2001

(65) Prior Publication Data

US 2002/0046664 A1 Apr. 25, 2002

Related U.S. Application Data

(60) Provisional application No. 60/234,804, filed on Sep. 25, 2000.

(51) Int. Cl.[7] ..... B41L 23/14; B41L 23/04

(52) U.S. Cl. ..... 101/148; 101/147

(58) Field of Search ..... 101/147, 148

(56) References Cited

U.S. PATENT DOCUMENTS 3,352,317 A 11/1967 Dahlgren
3,557,817 A 1/1971 Royse
4,300,450 A 11/1981 Gasparrini
4,607,261 A 8/1986 McCann et al.
4,608,158 A 8/1986 Ghisalberti et al.
5,053,200 A 10/1991 Schaeffer et al.
5,103,730 A 4/1992 Sarda
5,878,663 A 3/1999 Krzyzak

FOREIGN PATENT DOCUMENTS

EP 0 325 021 A2 7/1989

*Primary Examiner*—Daniel J. Colilla
(74) *Attorney, Agent, or Firm*—Pillsbury Winthrop LLP

(57) ABSTRACT

The present invention includes a dampening solution recirculator and a method for circulating dampening solution in a reservoir of a dampener. The dampening solution recirculator includes a tank for storing dampening solution, a pump for pumping dampening solution from the tank, a venturi positioned proximate the pump and the tank and including an inlet port in fluid communication with the pump, a suction port, and a discharge port in fluid communication with the tank. A feed conduit has a first end in fluid communication with the pump and a second end positioned above the reservoir. A suction conduit has a first end positioned at a predetermined level within the reservoir extending in a direction upwardly and away from the reservoir and a second end in fluid communication with the suction port.

28 Claims, 6 Drawing Sheets

DAMPENING SOLUTION RECIRCULATOR

CROSS-REFERENCE TO RELATED APPLICATION

This application claims the benefit of U.S. Provisional Patent Application No. 60/234,804, filed Sep. 25, 2000.

BACKGROUND OF THE INVENTION

1. Field of the Invention

The present invention relates generally to a dampening solution recirculator, and, more particularly, to a dampening solution recirculator for maintaining fountain solution in a solution reservoir of a two-roller continuous type dampener.

2. Background of the Related Art

A variety of dampeners have been developed for the application of dampening solution to printing plates mounted on offset lithographic printing presses. To date, three distinct types of dampeners have emerged. The oldest type is described as a "conventional," or "ductor" type dampener. The next type is a "slip-roller continuous" type dampener. And, more recently, the "two-roller continuous" type dampener was developed. Those skilled in the art will appreciate that most dampeners on the market today are variations or combinations of these three types.

The conventional type dampener has a pan roller, rotating at a speed less than press speed, that picks up dampening solution from a pan style solution reservoir. The dampening solution is transferred from the pan roller to a set of dampening rollers, rotating at a speed equal to press speed, by a ductor roller that alternately contacts the pan roller and one of the dampening rollers. A printing plate, on which the image to be printed is etched, is attached to a plate cylinder. After the solution is transferred to the dampening rollers, the rollers smooth out the solution to a somewhat consistent thickness and thereafter deposit it onto the non-image areas of the printing plate. The plate cylinder then rotates the plate past the press's inking form rollers which ink the image areas of the plate.

The slip-roller continuous type dampener also has a pan roller that rotates at a speed less than press speed and picks up the dampening solution from a pan style solution reservoir. Like the conventional system, the slip-roller continuous type dampener includes a set of dampening rollers, rotating at a speed equal to press speed, for smoothing out the dampening solution prior to the solution being applied to the printing plate. However, instead of the solution being transferred periodically from the pan roller to the dampening rollers by a ductor roller, the solution is transferred by a metering roller, which is in constant slipping-contact relationship with either the pan roller, one or both of the dampening rollers, or both the pan roller and one or both of the dampening rollers.

Both the conventional and slip-roller continuous type dampeners typically require the inclusion of 5% to 15% alcohol in the dampening solution. The alcohol reduces the surface tension of the solution; thereby enabling these type of dampeners to effectively wet the plate.

An example of a two-roller continuous type dampener is disclosed in U.S. Pat. No. 4,455,938 to Loudon, the entire disclosure of which is incorporated by reference herein. Loudon discloses a form roller having an ink receptive compressible surface pressed against a printing plate, which is attached to the plate cylinder. A metering roller presses against the form roller on a side of the form roller opposite the plate cylinder, forming a line of contact there between.

The form and metering rollers rotate at a speed equal to that which the press operates and in a direction that results in the formation of an upwardly-facing inward nip. An "inward nip" is defined as a zone near the line of contact between two rotating rollers toward which surfaces of the rollers approach. Seals are lightly pressed against the ends of the form roller and metering roller.

The "trough" created by the form roller, metering roller, and the seals form a solution reservoir in which dampening solution is stored. As the rollers in the dampener rotate, the solution is metered between the form and metering rollers and transferred to the plate by the form roller to the extent necessary to maintain the hydrophilic regions on the printing plate free of ink. The two-roller continuous type dampener has proven to be a substantial improvement over conventional and slip-roller continuous type dampeners in that it is a simpler design, easier to maintain and repair, requires only infrequent adjustments, and does not require alcohol to properly wet the plate.

In any dampener, dampening solution must be periodically replenished in the solution reservoir as it is consumed during the printing operation. The most basic method of replenishing dampening solution is by inverting a container of solution over the solution reservoir and positioning the opening of the container at a level that the solution is to be maintained. Disadvantages associated with this method include adverse chemistry changes in the solution reservoir caused by impurities, such as ink and paper dust, that migrate from the printing plate. Also, since the solution remains essentially stagnant in the reservoir, pH "hotspots" develop at remote locations in the reservoir. Furthermore, because the container must be positioned above and relatively nearby the reservoir, compromises must be made when choosing the size and location of the dampening solution container. Finally, such an arrangement makes it difficult to maintain and control the alcohol content of the dampening solution in those systems requiring the use of alcohol.

The advent of solution recirculators greatly improved conventional and slip-roller continuous type dampeners by eliminating many of the problems associated with inverted container type feeders. Solution recirculators typically include a housing in which a large solution storage tank is enclosed. A pump is attached to the tank for pumping solution through a supply conduit to the pan-style solution reservoir. A rigid tube extends through the bottom of the pan facilitating removal of excess solution from the pan. The level of solution in the reservoir is maintained by an adjustable collar that mates with the rigid tube on the interior of the pan. A return conduit provides fluid communication between the portion of the rigid tube extending from the bottom of the pan and the solution recirculator. The recirculator may include a chiller for lowering the temperature of the solution in the storage tank to reduce the evaporation rate of alcohol that may be included in the solution. Cooling the dampening solution has also been found advantageous for systems not requiring alcohol. Examples of solution recirculators are disclosed in U.S. Pat. No. 3,557,817 to Royse and U.S. Pat. No. 4,300,450 to Gasparrini.

One drawback inherent with prior art solution recirculating systems is that they are not adaptable to two-roller continuous type dampeners. This is primarily due to the fact that existing solution recirculators provide solution at relatively high and varying flow rates. In addition, excess solution in the reservoir is caused to return to the recirculator tank by employing gravity. In a dampener utilizing, for example, a pan type reservoir, these characteristics do not cause a problem. However, in a two-roller type continuous dampener these characteristics make solution recirculators unsuitable.

A dampener recirculator apparatus for a printing press is disclosed in U.S. Pat. No. 5,878,663 to Krzyzak et al. The recirculator apparatus makes it possible to utilize a solution recirculator with a two-roller type continuous dampener. More specifically, Krzyzak et al. disclose a dampening system that includes a two-roller continuous type dampener, solution recirculator, and a recirculator adapter. The solution recirculator is configured to supply solution through a supply conduit and to receive solution through a return conduit. The recirculator adapter includes a pressure regulator that receives solution from the supply conduit and regulates the solution flow to the dampener. A feed conduit provides fluid communication between the pressure regulator and the dampener's solution reservoir. The recirculator adapter further includes a venturi that receives solution from the supply conduit and induces a vacuum in a suction conduit. A first end of the suction conduit is positioned at a predetermined level within the dampener's solution reservoir and has a portion proximate the first end extending upwardly and away from the reservoir. A second end of the suction conduit is in fluid communication with the venturi. The venturi is in fluid communication with the return conduit for returning solution to the solution recirculator.

A disadvantage of Krzyzak et al. is that the recirculator adapter must be mounted on the printing press near the affected dampener. This reduces printers' access to the dampener from the side of the printing press to which the recirculator adapter is attached. Another disadvantage is that the recirculator adapter requires a pressure regulator. Such pressure regulators add significant cost to the recirculator adapter that can make it prohibitively expensive to sell. Yet another disadvantage is that installation of the recirculator adapter requires four additional water-tight connections. Those of ordinary skill in the art well appreciate that the more connections a fluid system has, the more likely it is that a system will leak fluid.

Considering the above-described disadvantages, it is clear that there is a need in the art for an improved device or method to adapt a solution recirculator so that it may be used to provide dampening solution to two-roller continuous type dampeners.

SUMMARY OF THE INVENTION

The present invention includes a dampening solution recirculator and a method for circulating dampening solution in a reservoir of a dampener. The dampening solution recirculator includes a tank for storing dampening solution, a pump for pumping dampening solution from the tank, a venturi positioned proximate the pump and the tank and including an inlet port in fluid communication with the pump, a suction port, and a discharge port in fluid communication with the tank, a feed conduit having a first end in fluid communication with the pump and a second end positioned above the reservoir, and a suction conduit having a first end positioned at a predetermined level within the reservoir extending in a direction upwardly and away from the reservoir, and a second end in fluid communication with the suction port. The venturi may be located inside the tank and includes a venturi nozzle tapered at an angle between about 5 and 10 degrees, and preferably at an angle of about 7 degrees in relation to the axis of the venturi. The dampening solution recirculator further includes a chiller in fluid communication with the pump and the first end of the feed conduit for providing refrigerated solution to the reservoir. A filter is positioned in the tank in fluid communication with the discharge port of the venturi.

The dampener includes a bracket attached to and extending over the reservoir of the dampener. The first end of the suction conduit is mounted to the bracket. A means is provided for adjusting the bracket vertically to alter the level of dampening solution in the reservoir.

The method for circulating dampening solution in a reservoir of a dampener includes the step of providing a dampening solution recirculator that includes a tank, a pump in fluid communication with the tank, a venturi positioned proximate the pump and tank, the venturi having an inlet port in fluid communication with the pump, a suction port, and a discharge port in fluid communication with the tank, a feed conduit having a first end and a second end, the first end in fluid communication with the pump, and a suction conduit having a first end and a second end, the first end in fluid communication with the suction port. The method further includes the steps of storing dampening solution in the storage tank, positioning the second end of the feed conduit above the reservoir for feeding dampening solution into the reservoir, positioning the second end of the suction conduit at a predetermined level within the reservoir and having a portion proximate the second end of the suction conduit extending upwardly and away from the reservoir, and pumping dampening solution from the storage tank to the inlet port of the venturi and the first end of the feed conduit.

The method further includes the step of pumping dampening solution through a chiller to refrigerate the dampening solution prior to supplying the solution to the reservoir. The method further includes the steps of mounting the second end of the feed conduit and the second end of the suction conduit to a vertically adjustable bracket extending over the reservoir and adjusting the adjustable bracket to adjust the level of the dampening solution in the reservoir.

These and other features of the present invention will become more readily apparent to those of ordinary skill in the art upon a review of the following brief description of the drawings, detailed description of the preferred embodiments, and the figures appended hereto.

BRIEF DESCRIPTION OF THE DRAWINGS

So that those of ordinary skill in the art to which the subject invention pertains will more readily understand how to make and use the dampening solution recirculator of the present invention, preferred embodiments of the invention will be described in detail with reference to the following drawings, wherein.

DETAILED DESCRIPTION OF THE PREFERRED EMBODIMENTS

Figure 1:
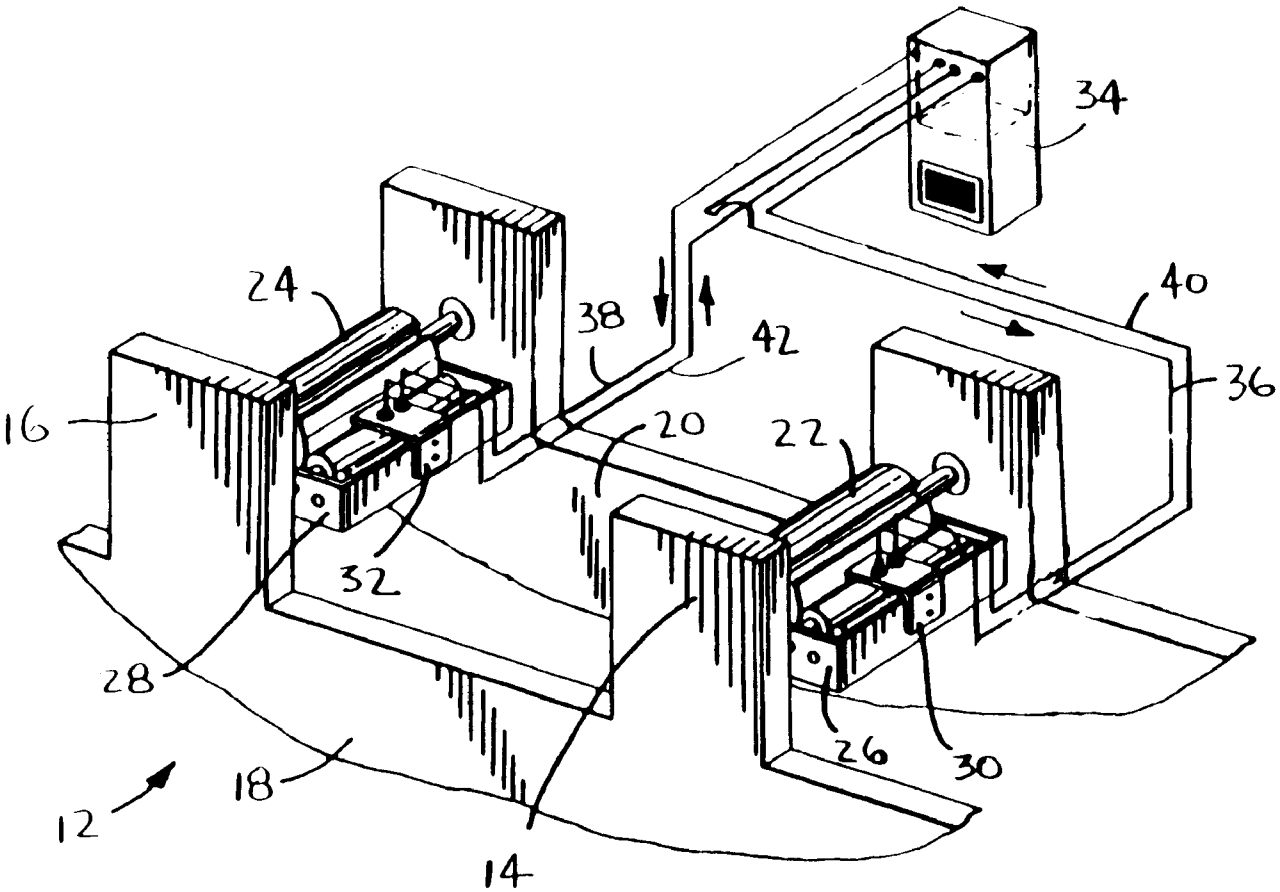
FIG. 1 is a perspective view of two printing heads of a printing press and a dampening solution recirculator for providing dampening solution to the dampener of each printing head.

Referring now to the drawings wherein like reference numerals identify similar structural elements of the subject invention, there is illustrated in FIG. 1 a printing press 12 supporting a first color head 14 and a second color head 16.

Printing press 12 is of the type used for offset lithographic printing and is shown greatly simplified to ease in illustrating the present invention. Those skilled in the art will readily recognize that various other components, e.g., blanket cylinders, impression cylinders, inking rollers, roller hangers, paper handling mechanisms, etc., are required for an accurate depiction of an offset lithographic a printing press.

Printing press 12 includes a near-side frame 18 and a far-side frame 20 between which are supported a first plate cylinder 22 and a second plate cylinder 24. Printing plates, that is, aluminum or polyester sheets that are etched or otherwise processed to carry an image that is to be printed, are attached to the outer diameters of plate cylinders 22 and 24. A first color head dampener 26 is mounted between the near-side frame 18 and the far-side frame 20 adjacent plate cylinder 22. Similarly, a second color head dampener 28 is mounted between the near-side frame 18 and the far-side frame 20 adjacent plate cylinder 24.

Dampeners 26 and 28 are two-roller continuous type dampeners such as those described in U.S. Pat. No. 4,455,938 to Loudon, entitled DAMPENING APPARATUS FOR LIGHOGRAPHIC PRESS, and as described in U.S. Pat. No. 6,095,042 to Jakobsen et al., entitled DAMPENER ACTIVATION APPARATUS AND METHOD, the disclosures of which are incorporated by reference herein. Dampening solution reservoirs are formed between the form roller, metering roller, and end seals in each dampener 26 and 28. The first color head dampener 26 includes a first feed bracket 30 and the second color head dampener 28 includes a second feed bracket 32. Both feed brackets 30 and 32 are adjustable in the vertical direction, that is, both feed brackets 30 and 32 are adjustable toward and away from the dampening solution reservoir of each dampener 26 and 28. A means for adjusting brackets 30 and 32 is provided. The means may be any mechanism known to those of ordinary skill in the art for making such adjustments including, but no limited to, providing screws that are threaded into the rear plates of each dampener that extend through vertically-slotted holes provided in each bracket.

The first color head dampener 26 is configured to apply a thin even film of dampening solution onto the hydrophilic portions of a printing plate mounted the first plate cylinder 22. Likewise, the second color head dampener 28 is configured to apply a thin even film of dampening solution onto the hydrophilic portions of a printing plate mounted on the second plate cylinder 24.

Dampeners 26 and 28 are coupled to the printing press 12 with mechanisms (not shown) facilitating their controlled movement either toward or away from plate cylinders 22 and 24, respectively. This movement causes each dampener 26 and 28 form roller to contact the plate mounted on its corresponding plate cylinder 22 and 24 when the associated printing head 14 and 16 is to be used during a printing operation. Conversely, the mechanism separates the dampener 26 and 28 form roller from its respective plate cylinder 22 and 24 when the printing head associated therewith is not to be used. On more modern printing presses, particularly those having multiple printing heads, each dampener can also be disabled from rotating so that when the press is rotating and the printing operation is initiated, the disabled dampener remains separated from its plate cylinder and is prevented from rotating. Examples of these mechanisms are illustrated and described in Jakobsen et al.

A dampening solution recirculator 34 is configured to provide dampening solution to the reservoir of the first color head dampener 26 and the reservoir of the second color head dampener 28 through conduit 36 and conduit 38, respectively. The dampening solution recirculator 34 is also configured to return excess dampening solution from the reservoirs of the first color head dampener 26 and the second color head dampener 28 through conduit 40 and conduit 42, respectively. The height of fountain solution in the reservoir of the first color head dampener 26 can be adjusted by adjusting the height of solution feed bracket 30. Likewise, the height of solution in the reservoir of the second color head dampener 28 can be adjusted by adjusting the height of solution feed bracket 32 with respect to the dampener 28.

Figure 2:
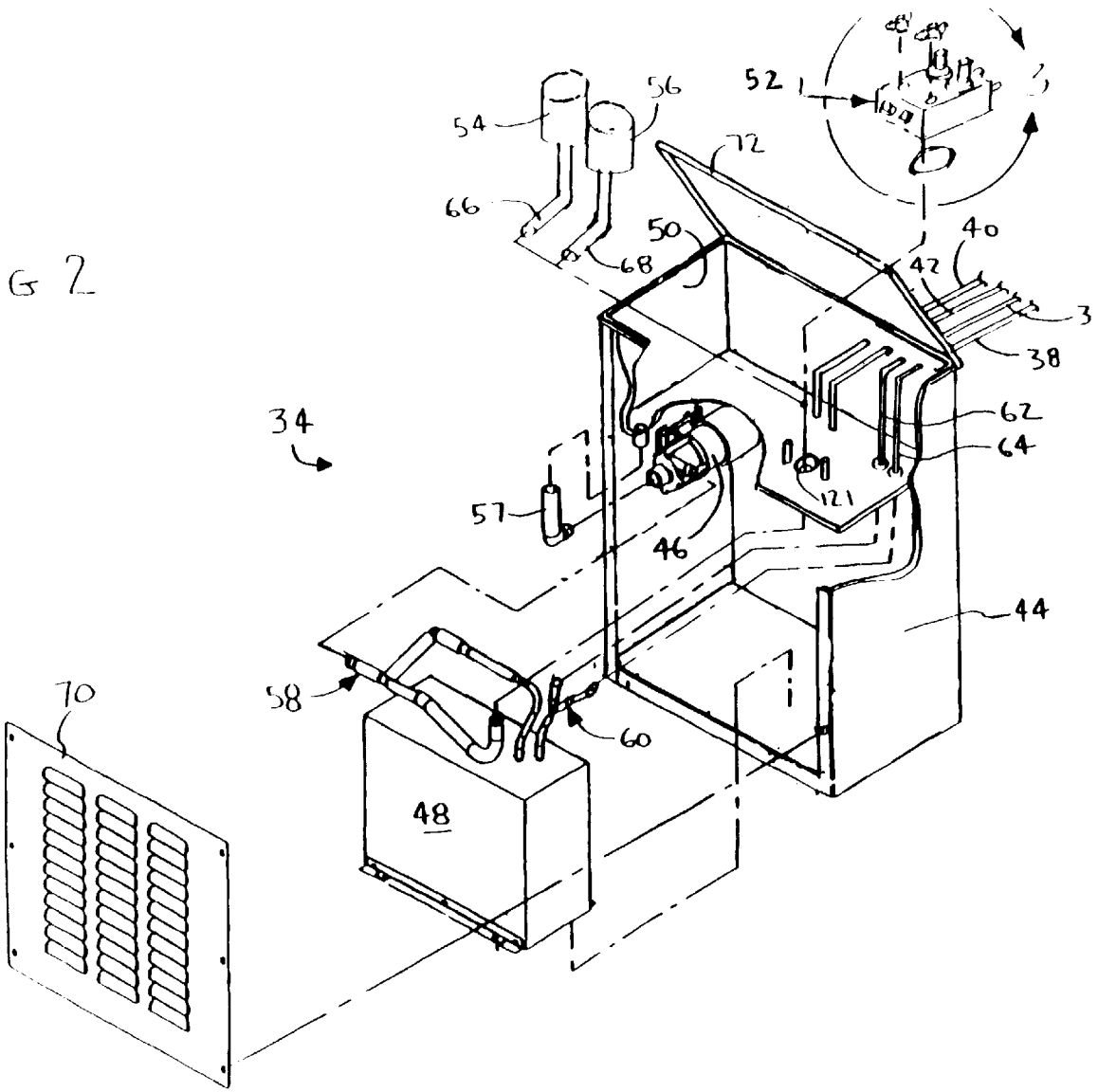
FIG. 2 is an exploded perspective view of a dampening solution recirculator, wherein a portion has been cut away to facilitate a description of the invention.

Referring to FIG. 2, the dampening solution recirculator 34 is illustrated in exploded prospective view, wherein a portion has been cut away to facilitate a description of the invention. The recirculator 34 generally includes an enclosure 44 that houses a pump 46, a chiller 48, a storage tank 50, an ejector 52, and filters 54 and 56. Storage tank 50 is in fluid communication with pump 46 through conduit 57. Pump 46 is in fluid communication with the chiller 48 through a branch of conduit 58. Pump 46 is also in fluid communication with an inlet port of ejector 52 through a second branch of conduit 58 and a flanged fitting attached to the bottom of storage tank 50. A more detailed description of the assembly of conduit 58 and ejector 52 to storage tank 50 is provided herein below and illustrated in FIG. 3.

Chiller 48 is in fluid communication with conduit 36 through a branch of conduit 60 and conduit 62. Chiller 48 is also in fluid communication with conduit 38 through a second branch of conduit 60 and conduit 64. Conduits 62 and 64 provide passage of solution through storage tank 50.

Referring to FIG. 1, as described above, conduit 36 provides fluid communication between recirculator 34 and the solution reservoir of the first color head dampener 26, and conduit 38 provides fluid communication between recirculator 34 and the solution reservoir of the second color head dampener 28 (FIG. 1). As also described above, conduit 40 provides fluid communication between the solution reservoir of the first color head dampener 26 and recirculator 34, and conduit 42 provides fluid communication between the reservoir of the second color head dampener 28 and recirculator 34.

Referring to FIG. 2, conduits 40 and 42 penetrate through a side-wall of storage tank 50 and mate with respective suction ports of ejector 52. Respective discharge ports of ejector 52 are in fluid communication with filter 54 through conduit 66 and in fluid communication with filter 56 through conduit 68. A vented cover 70 encloses the components within the enclosure 44 and a hinged lid 72 encloses the dampening solution holding area of storage tank 50. Those skilled in the art will appreciate that the recirculator 34 also includes an electrical system (not shown) having various electrical components for providing power and control of the recirculator 34.

Figure 3:
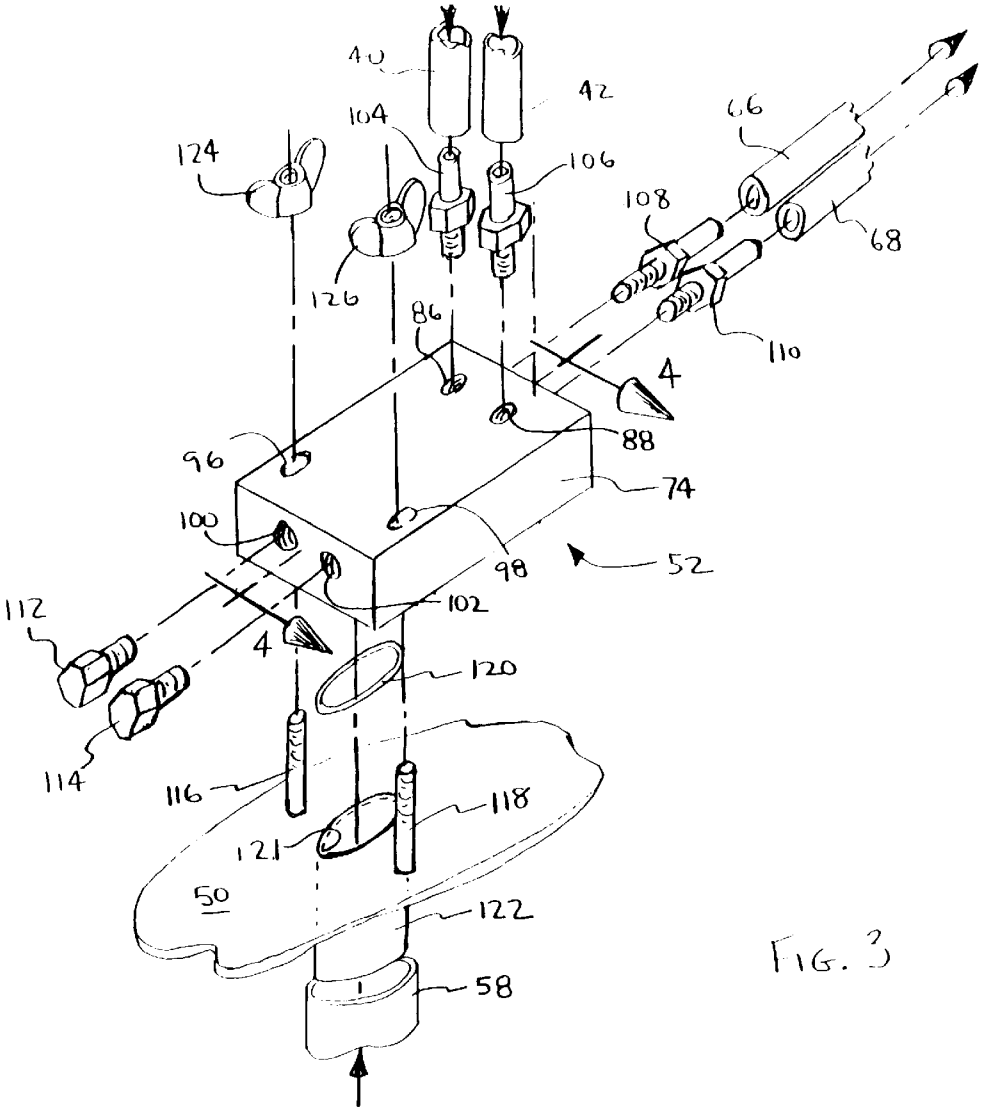
FIG. 3 is an exploded perspective view, taken from FIG. 2, of an ejector illustrating how the ejector is assembled and mounted to a solution tank in a dampening solution recirculator.
Figure 4:
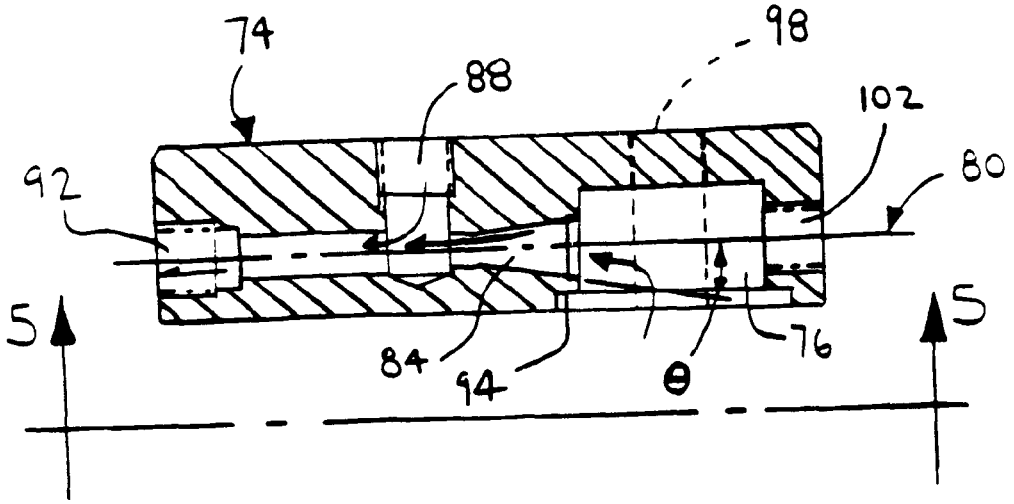
FIG. 4 is a cross-sectioned elevational view, taken along line 4—4 in FIG. 3, of an ejector body.
Figure 5:
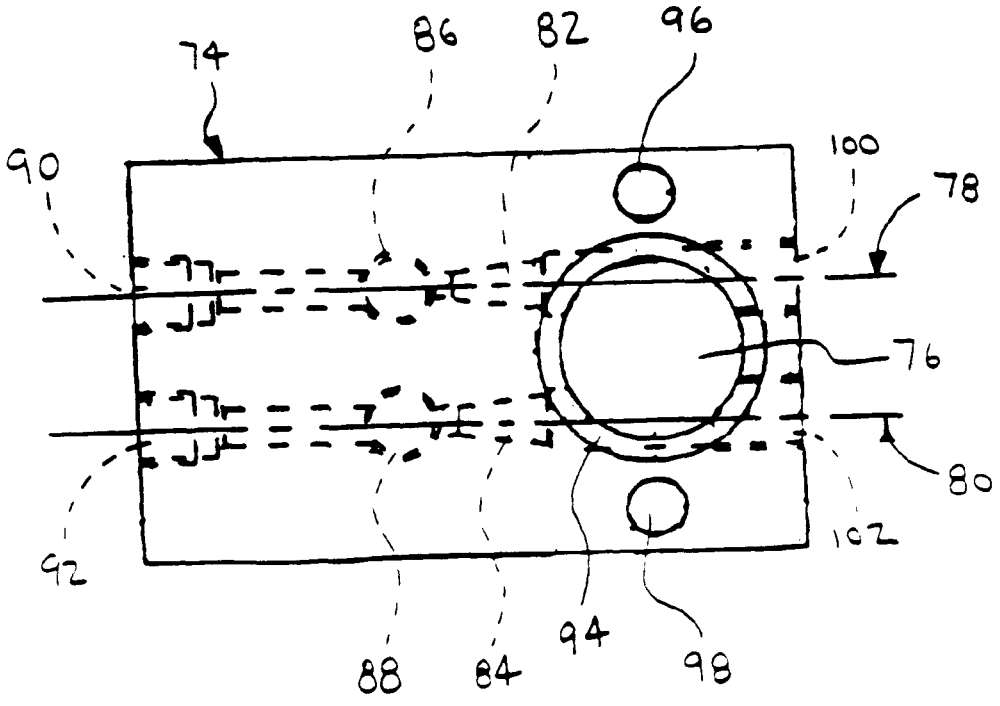
FIG. 5 is a bottom view, taken along line 5—5 in FIG. 4, of the ejector body.

Referring to FIGS. 3–5, FIG. 3 is an exploded perspective view, taken from FIG. 2, illustrating various parts of the ejector 52 and how it is assembled to the solution tank 50; FIG. 4 is a cross-sectional elevational view, taken along line 4—4 of FIG. 3, of ejector body 74 of ejector 52; and FIG. 5 is a bottom view, taken along line 5—5 of FIG. 4, of ejector body 74.

Referring to FIGS. 4 and 5, the ejector body 74 includes an inlet port 76 for feeding dampening solution to venturis 78 and 80. Venturi 78 is used for generating suction to withdraw fountain solution from the solution reservoir of the first color head dampener 26 and venturi 80 is used for generating suction for withdrawing fountain solution from the solution reservoir of the second color head dampener 28. More specifically, each venturi 78 and 80 includes a venturi nozzle 82 and 84 for generating suction at threaded suction ports 86 and 88, respectively. Experimentation has shown satisfactory venturi performance can be achieved for varied conditions when the walls of the venturi nozzles 82 and 84 are tapered at about a 5 to 10 degree angle in relation to their respective axes, and, more preferably, tapered at about a 7 degree angle in relation to their respective axes. The angle is represented in FIG. 4 by the symbol θ.

As the flow-arrows in FIG. 4 illustrate, dampener solution that is pumped into the inlet port 76 and suctioned through suction ports 86 and 88 is discharged out threaded discharge ports 90 and 92, respectively. An o-ring seat 94 is provided on the circumference proximate the opening to the inlet port 76 to facilitate creating a water-tight seal between the ejector body 74 and an opening in the bottom of the reservoir 50 to which conduit 58 is attached. (See FIGS. 2 and 3.) Two through-holes 96 and 98 extend through ejector body 74 on diametrically opposite sides of inlet port 76 to facilitate attachment of the ejector body 74 to the reservoir 50. Threaded access ports 100 and 102 are provided to facilitate manufacture of venturis 78 and 80, respectively.

Referring to FIG. 3–5, ejector 52 includes suction fittings 104 and 106 that are threaded into suction ports 86 and 88 for attaching conduits 40 and 42, respectively, to ejector body 74. Discharge fittings 108 and 110 are threaded into discharge ports 90 and 92 for attaching conduits 66 and 68, respectively, to ejector body 74. Blanking plugs 112 and 114 are threaded into access ports 100 and 102, respectively, to block them off. The ejector 52 is mounted by through-holes 96 and 98 onto threaded studs 116 and 118, respectively, which extend from the bottom of solution tank 50. An o-ring 120 is seated in seat 94 of ejector body 74 to provide a seal between the ejector body 74 and an opening 121 in the bottom of solution tank 50. Conduit 58 is clamped to a flange 122 that extends from the bottom of the solution tank 50 around the opening 121. Wing nuts 124 and 126 threadingly secure the ejector 52 to the threaded studs 116 and 118, respectively. Flow-arrows illustrate the flow of solution into and out of ejector 52.

Figure 6:
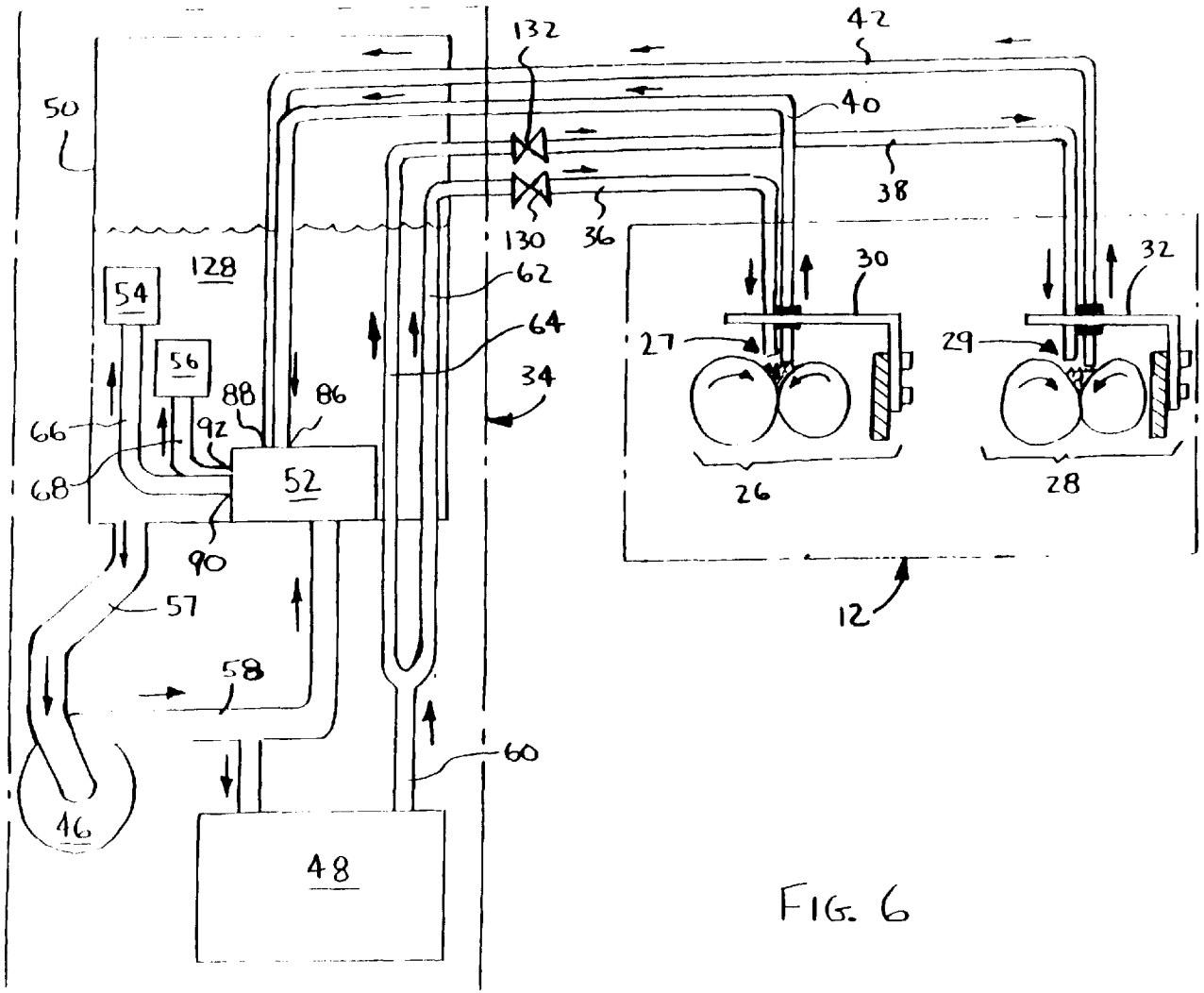
FIG. 6 is a schematic view of a dampening solution recirculator configured for supplying dampening solution to dampeners in two printing heads of a printing press.

Referring to FIG. 6, a schematic view illustrates the dampening solution recirculator 34 configured for supplying dampening solution to the solution reservoir of the first color head dampener 26 and the second color head dampener 28 of printing press 12. In operation, dampening solution 128 that is stored in solution tank 50 is pumped by pump 46 from solution tank 50, through conduits 57 and 58, and to chiller 48 and the inlet port 76 of ejector 52. The solution that passes through chiller 48 is refrigerated and thereafter travels through conduits 60, 62, and 36 to reservoir 27 of the first color head dampener 26. Likewise, the solution that passes through chiller 48 travels through conduits 60, 64, and 38 to reservoir 29 of the second color head dampener 28. Valves 130 and 132 may be included in conduits 36 and 38, respectively, to enable an operator to open or close off the feed of solution to either or both of dampeners 26 and 28.

Solution that passes through venturis 78 and 80 of ejector 52 create suction heads at suction ports 86 and 88, respectively. Excess solution in reservoirs 27 and 29 of dampeners 26 and 28 is drawn off through conduits 40 and 42 by the suction heads developed at suction ports 86 and 88 and discharged through discharge ports 90 and 92, respectively. Discharged solution flows from discharge ports 90 and 92 through conduits 66 and 68 to filters 54 and 56, respectively; thereby returning excess solution in reservoirs 27 and 29 to solution tank 50. Those of ordinary skill in the art should appreciate that any number of dampeners may be accommodated by, for example, adding pumps, ejectors, conduits, etc. as necessary to the dampener solution recirculator 34 and providing attachment brackets to the additional dampeners to allow attachment of the conduits.

Figure 7:
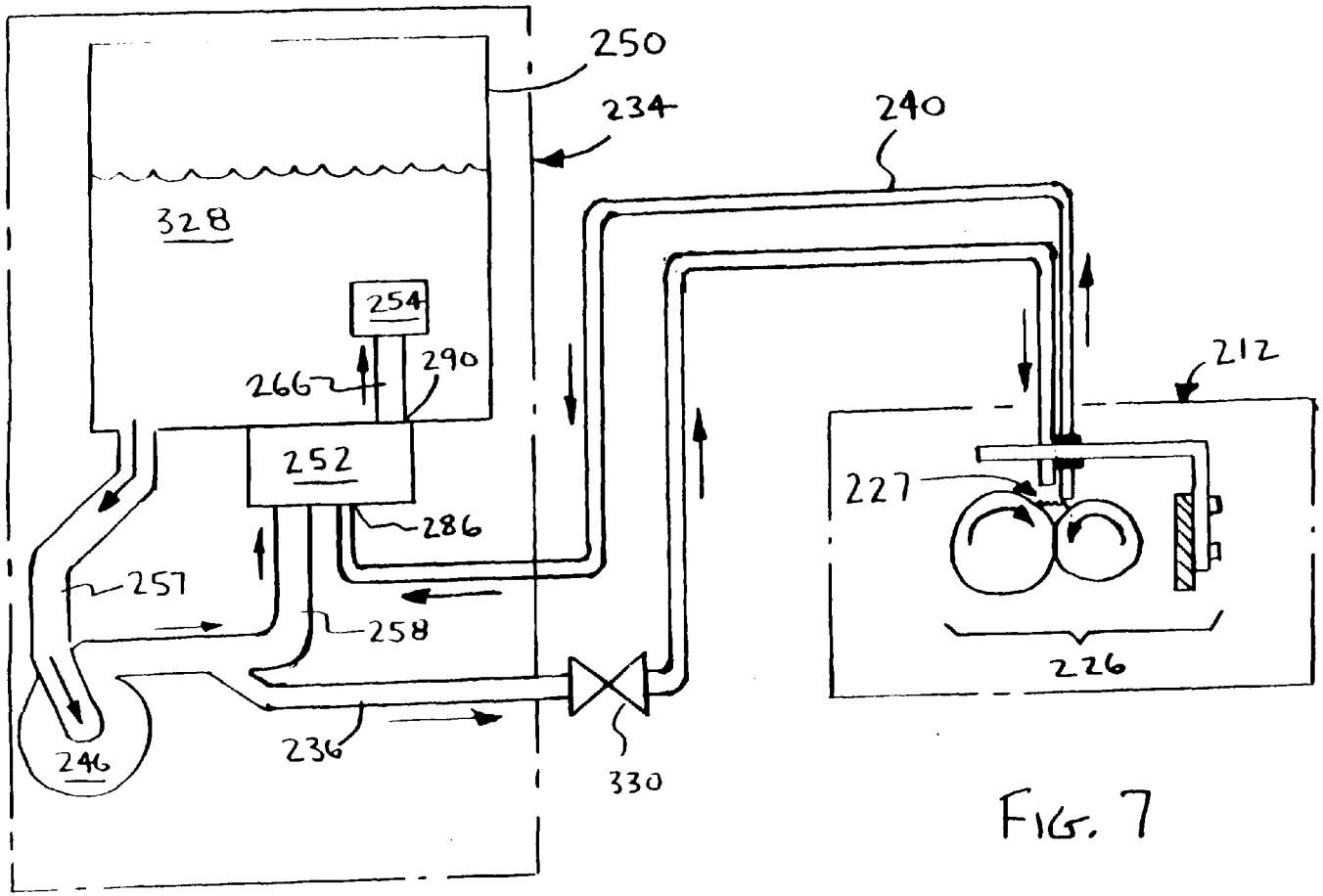
FIG. 7 is a schematic view of an embodiment of a dampening solution recirculator configured for supplying dampening solution to a dampener in a printing head of a printing press.

Referring to FIG. 7, a schematic view illustrates another embodiment of the present invention, wherein a dampening solution recirculator 234 is configured for supplying dampening solution to a dampener 226 of a printing press 212. In operation, dampening solution 328 stored in a solution tank 250 is pumped by the pump 246 from the tank 250, through conduits 257 and 258 to the inlet port of ejector 252. Ejector 252 is substantially similar to ejector 52; however, it includes only a single venturi and the associated fittings (not shown.) Solution 328 stored in solution tank 250 is also pumped by pump 246 from reservoir 250 through conduits 257 and 236 to the reservoir 227 of dampener 226. A valve 330 may be included in conduit 236 to enable an operator to open or close off the feed of solution to dampener 226.

Solution that passes through the venturi of ejector 252 creates a suction head at suction port 286. Excess solution in the reservoir 227 of dampener 226 is drawn off through conduit 240 by the suction head at suction port 286 and discharged through discharge port 290. Discharged solution flows from discharge port 290 through conduit 266 to filter 254; thereby returning excess solution in the reservoir 227 of dampener 226 to the solution tank 250. Those of ordinary skill in the art will appreciate that any number of dampening systems may be accommodated by, for example, adding pumps, ejectors, conduits, etc. as necessary to the dampener solution recirculator 234 and providing attachment brackets to the additional dampeners to allow attachment of the conduits.

Although the invention is described herein above to maintain the level of dampening solution in a solution reservoir of a two-roller continuous type dampener, it is envisioned that the dampening solution recirculator can be readily modified for use in supplying dampening solution to other types of dampeners, wherein the flow of solution supplied by a dampening solution recirculator is required to be circulated through a reservoir in like manner. In particular, where the solution must be drawn upwardly and away from the surface of the solution in the reservoir.

Even though the preferred embodiment of the invention has been illustrated and described herein, it is intended to be understood by those of ordinary skill in the art that various changes or modifications can be made to the invention without departing from the spirit and scope of the invention as defined in the appended claims.

What is claimed is:

1. A dampening solution recirculator for circulating dampening solution in a reservoir of a dampener, comprising:

a tank for storing dampening solution;

a pump for pumping dampening solution from the tank;

an ejector mounted to the recirculator, the ejector including an inlet port in fluid communication with the pump, a suction port, a discharge port in fluid communication with the tank, and a venturi between the inlet port, the suction port, and the discharge port, the venturi including a venturi nozzle between the inlet port and the suction port;

a feed conduit having a first end in fluid communication with the pump and a second end positioned above the reservoir; and a suction conduit having a first end extending downward to a predetermined level within the reservoir, and a second end in fluid communication with the suction port.

2. A dampening solution recirculator as recited in claim 1, wherein the ejector is located inside the tank.

3. A dampening solution recirculator as recited in claim 1, wherein the venturi nozzle is tapered at an angle between about 5 and 10 degrees in relation to the axis of the venturi.

4. A dampening solution recirculator as recited in claim 3, wherein the venturi nozzle is tapered at an angle of about 7 degrees in relation to the axis of the venturi.

5. A dampening solution recirculator as recited in claim 1, further including a chiller in fluid communication with the pump and the first end of the feed conduit for providing refrigerated solution to the reservoir.

6. A dampening solution recirculator as recited in claim 1, further including a valve in the feed conduit for adjusting the flow of dampening solution to the reservoir.

7. A dampening solution recirculator as recited in claim 1, further including a filter located inside the tank and in fluid communication with the discharge port.

8. A dampening solution recirculator as recited in claim 1, further including a bracket attached to the dampener and wherein the first end of the suction conduit is mounted to the bracket.

9. A dampening solution recirculator as recited in claim 8, further including a means for vertically adjusting the bracket to allow adjustment of the level of dampening solution in the reservoir.

10. A dampening solution recirculator as recited in claim 8, further including a suction fitting in fluid communication with the first end of the suction conduit and attached to the bracket, the suction fitting having an extension depending there from that extends a predetermined distance into the reservoir.

11. A dampening solution recirculator for circulating dampening solution in a reservoir of a dampener, comprising:

a tank for storing dampening solution;

a pump for pumping dampening solution from the tank;

a venturi mounted inside and to the bottom of the tank, the venturi including an inlet port in fluid communication with the pump, a suction port, and a discharge port in fluid communication with the tank, wherein dampening solution is fed from the pump, through the bottom of the tank, and into the inlet port of the venturi;

a feed conduit having a first end in fluid communication with the pump and a second end positioned above the reservoir; and a suction conduit having a first end extending downward to a predetermined level within the reservoir, and a second end in fluid communication with the suction port.

12. A dampening solution recirculator for circulating dampening solution in a reservoir of a dampener, comprising:

a tank for storing dampening solution;

a pump including an inlet and an outlet, the pump inlet in fluid communication with the tank;

a venturi mounted to the recirculator, the venturi including an inlet port in fluid communication with the pump outlet, a suction port, a discharge port in fluid communication with the tank, and a venturi nozzle between the inlet port and the suction port, wherein a vacuum is induced in the suction port when dampening solution passes from the inlet port to the discharge port;

a feed conduit providing fluid communication between the pump outlet and the reservoir; and a suction conduit having a first end positioned at a predetermined level within the reservoir, a portion proximate the first end extending upwardly and away from the reservoir, and a second end in fluid communication with the suction port.

13. A dampening solution recirculator as recited in claim 12, wherein the venturi is positioned inside the tank.

14. A dampening solution recirculator as recited in claim 12, wherein the venturi nozzle is tapered between an angle of about 5 and 10 degrees in relation to the axis of the venturi.

15. A dampening solution recirculator as recited in claim 14, wherein the venturi nozzle is tapered at an angle of about 7 degrees in relation to the axis of the venturi.

16. A dampening solution recirculator as recited in claim 12, further including a chiller having an inlet and an outlet, the chiller inlet in fluid communication with the pump outlet and the chiller outlet in fluid communication with the feed conduit for providing refrigerated solution to the reservoir.

17. A dampening solution recirculator as recited in claim 12, further including a valve in the feed conduit for adjusting the flow of dampening solution to the reservoir.

18. A dampening solution recirculator as recited in claim 12, further including a filter located inside the tank and in fluid communication with the discharge port of the venturi.

19. A dampening solution recirculator as recited in claim 12, further including a bracket attached to the dampener and wherein the first end of the suction conduit is mounted to the bracket.

20. A dampening solution recirculator as recited in claim 19, further including a means for vertically adjusting the bracket to allow adjustment of the level of dampening solution in the reservoir.

21. A dampening solution recirculator as recited in claim 19, further including a suction fitting in fluid communication with the first end of the suction conduit and attached to the bracket, said suction fitting having an extension depending therefrom that extends a predetermined distance into the reservoir.

22. A dampening solution recirculator for circulating dampening solution in a reservoir of a dampener, comprising:

a tank for storing dampening solution;

a pump including an inlet and an outlet, the pump inlet in fluid communication with the tank;

a venturi positioned inside of and mounted to the bottom of the tank, the venturi including an inlet port in fluid communication with the pump outlet, a suction port, and a discharge port in fluid communication with the tank, wherein a vacuum is induced in the suction port when dampening solution passes from the inlet port to the discharge port, and wherein dampening solution is fed from the pump, through the bottom of the tank, and into the inlet port of the venturi;

a feed conduit providing fluid communication between the pump outlet and the reservoir; and a suction conduit having a first end positioned at a predetermined level within the reservoir, a portion proximate the first end extending upwardly and away from the reservoir, and a second end in fluid communication with the suction port.

23. A method for circulating dampening solution in a reservoir of a dampener, the method comprising:

providing a dampening solution recirculator including a tank for storing dampening solution, a pump in fluid communication with the tank, a venturi mounted to the recirculator, the venturi including an inlet port in fluid communication with the pump, a suction port, a discharge port in fluid communication with the tank, and a venturi nozzle between the inlet port and the suction port for inducing a vacuum in the suction port when dampening solution passes from the inlet port to the discharge port, a feed conduit having a first end and a second end, the first end in fluid communication with the pump, and a suction conduit having a first end and a second end, the first end in fluid communication with the suction port;

storing dampening solution in the tank;

positioning the second end of the feed conduit above the reservoir for feeding dampening solution into the reservoir;

positioning the second end of the suction conduit at a predetermined level within the reservoir and having a portion proximate the second end of the suction conduit extending upwardly and away from the reservoir; and pumping dampening solution from the tank to the inlet port of the venturi and the first end of the feed conduit.

24. A method for circulating dampening solution as recited in claim 23, wherein the step of pumping dampening solution from the tank to the inlet port further includes pumping dampening solution through a chiller to refrigerate the dampening solution prior to supplying the solution to the reservoir.

25. A method for circulating dampening solution as recited in claim 23, wherein the step of positioning the second end of the feed conduit above the reservoir for feeding dampening solution into the reservoir further includes mounting the second end of the feed conduit to a bracket extending over the reservoir.

26. A method for circulating dampening solution as recited in claim 23, wherein the step of positioning the second end of the suction conduit at a predetermined level within the reservoir and having a portion proximate the second end of the suction conduit extending upwardly and away from the reservoir further includes mounting the second end of the suction conduit to an adjustable bracket extending over the reservoir.

27. A method for circulating dampening solution as recited in claim 26, further including the step of vertically adjusting the bracket extending over the reservoir to adjust the level of the dampening solution in the reservoir.

28. A method for circulating dampening solution as recited in claim 23, wherein the step of providing a dampening solution recirculator further includes the steps of providing a valve in the feed conduit and adjusting the flow of dampening solution to the reservoir.

* * * * *